United States Patent [19]

Ferreira et al.

[11] 4,182,497

[45] Jan. 8, 1980

[54] GUTTER CLEANING DEVICE

[76] Inventors: Richard A. Ferreira, 82 Taunton Ave.; Manuel J. Brito, 32 Colonial Rd., both of East Providence, R.I. 02914

[21] Appl. No.: 868,070

[22] Filed: Jan. 9, 1978

[51] Int. Cl.[2] ..... B05B 9/08

[52] U.S. Cl. ..... 239/532; 239/583

[58] Field of Search ..... 239/532, 587, 280; 15/330, 236 R; 294/19 R

[56] References Cited

U.S. PATENT DOCUMENTS

| | | | |
|---|---|---|---|
| 3,858,267 | 1/1975 | Swannie | 294/19 R |
| 3,908,910 | 7/1975 | Detwiler | 239/587 |

*Primary Examiner*—James B. Marbert

*Attorney, Agent, or Firm*—Salter & Michaelson

[57] ABSTRACT

A gutter cleaning device adapted to remove leaves and other debris from household gutters is disclosed in which a generally flat blade-like working head is connected to an elongated hollow handle. Fluid, such as water from a garden hose, is directed through the handle and into the working head whereupon it exits through a plurality of discharge openings provided in each of the sidewalls in part forming the head so as to direct a plurality of streams along the inside surface of the gutter. The device may be moved back and forth or in one direction along the gutter and in this way the fluid stream serves to loosen and/or force leaves and debris in front of the working head to accordingly enable the gutters to be so cleaned.

4 Claims, 5 Drawing Figures

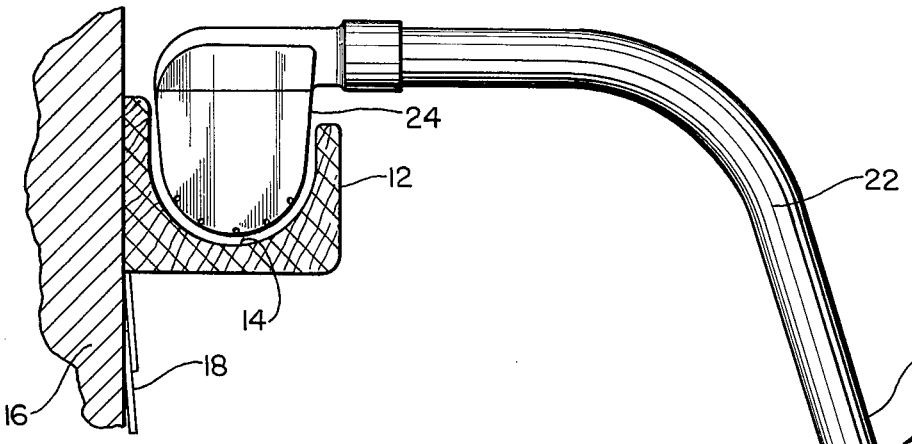
FIG. 3
FIG. 1
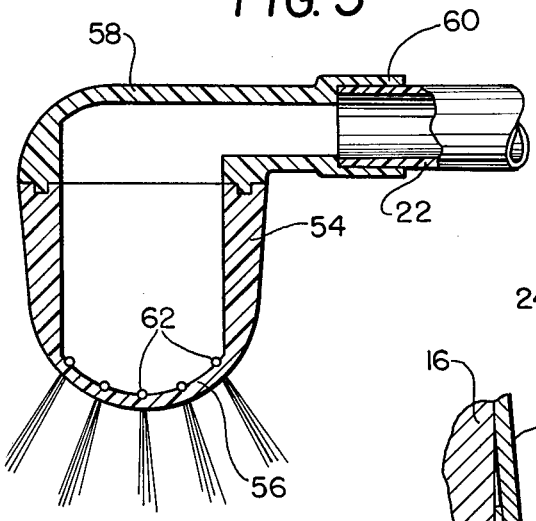
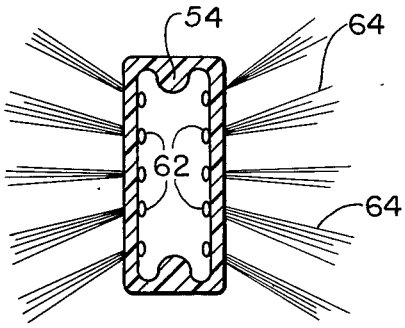
FIG. 4
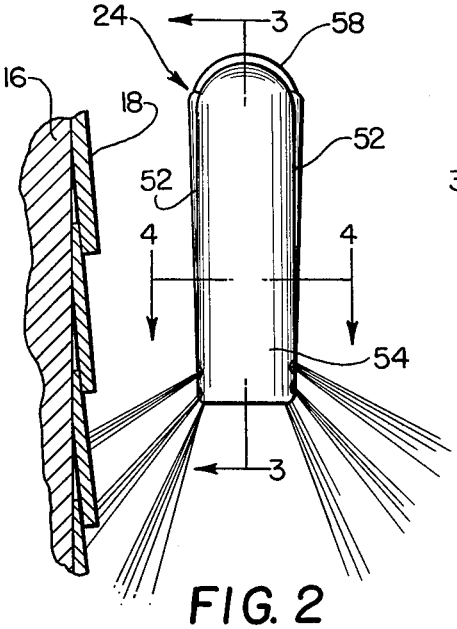
FIG. 2
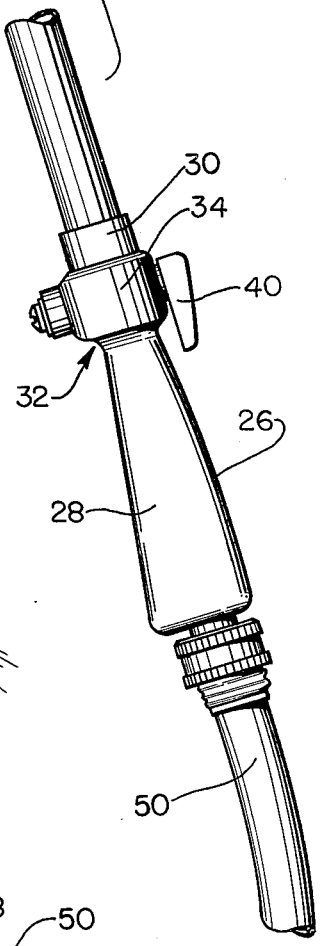
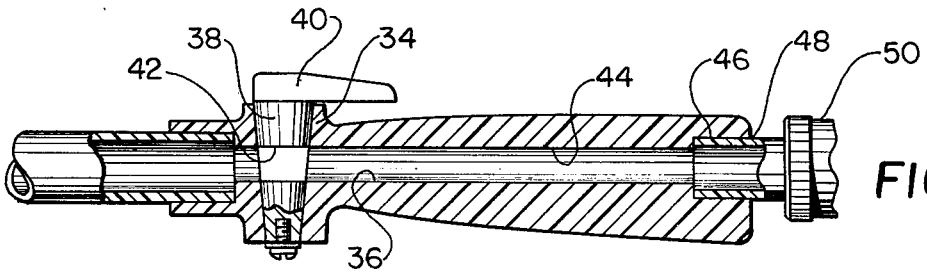
FIG. 5

GUTTER CLEANING DEVICE

BACKGROUND OF THE INVENTION

This invention relates to a cleaning device and more particularly to a device which may be used to clean leaves and other debris from the gutters or eave troughs of houses and other buildings.

It is a common household problem that leaves, twigs and other debris collect in the roof gutters of homes and other buildings and if not periodically removed therefrom, accumulate to the point of interfering with the drainage function of the gutters. In order to remove this material, the homeowner must generally climb up to the gutter by use of a ladder placed along the side thereof, clean that portion of the gutter reachable from the ladder and then repeat the procedure as to different locations along the gutter until it is completely cleaned. Alternatively, the homeowner may climb on the roof of the home and proceed to clean the gutter with a hand tool or the like while positioned on the roof edge. This latter procedure is not only time-consuming and laborious, as is the previously indicated procedure, but further includes a greater possible risk of injury to the homeowner. Further, climbing and walking along the edge of the roof is injurious to the roof shingles and can readily cause roof problems requiring further work and repair by the homeowner or others.

Attempts have been made to avoid the necessity of removing gutter debris by enabling the homeowner to stand on the ground while manipulating a device that directs water into the gutter so as to wash away the debris. Devices which operate in this manner include those described in the following U.S. Pat. Nos.: 2,623,234 issued Dec. 30, 1952, 2,910,711 issued Nov. 3, 1959, 3,023,971 issued Mar. 6, 1962 and 3,908,910 issued Sept. 30, 1975. Despite the existence of such devices, the need still exists for a simple and effectively operable device which can be easily manipulated by the homeowner in a safe and effective manner. The above citation of the prior art patents constitutes applicant's Prior Art Disclosure, and in such regard, a copy of each such patent is included with this application.

SUMMARY OF THE INVENTION

The present invention provides such a device which can be easily and efficiently utilized by a person standing on the ground. The device is in the form of an elongated, generally tubular hollow handle having a lower end adapted to be held by the person manipulating the device and to receive a source of pressurized water as from a garden hose. The upper end of the handle includes a working head attached thereto. This working head includes sidewalls and a lower end wall defining a lower terminal portion adapted to downwardly extend into the gutter, said sidewalls including a plurality of fluid discharge openings extending therethrough and adapted to direct fluid along the inner gutter surface so as to force leaves and debris therefrom.

A feature of the present invention is accordingly to provide a gutter cleaning device of the above described type wherein an operative cleansing flow is directed essentially parallel to the inner surfaces of the gutters so as to force debris found therein away from the device.

A further feature of the invention is the provision of a gutter cleaning device which can alternatively be utilized to additionally clean the walls and/or windows of the house or other gutter supporting structure.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a somewhat stylized elevational view of a gutter cleaning device embodying features of the present invention and operationally disposed so as to clean a gutter;

FIG. 2 is a side view with parts removed for clarity of the device shown in FIG. 1, but in an alternate use position;

FIG. 3 is a side sectional view taken along the line 3—3 of FIG. 2;

FIG. 4 is a plan sectional view taken along the line 4—4 of FIG. 2; and FIG. 5 is a partial sectional view taken along the lower handle segment of the device of FIG. 1, and shows in particular the manner in which fluid such as water may be introduced to the device.

DESCRIPTION OF THE INVENTION

FIG. 1 of the drawing shows the cleaning device 10 of the present invention disposed in such a manner so as to remove accumulated leaves and other debris from the inner surfaces of a gutter 12. Such gutter may be of conventional configuration and exhibits an internal water-receiving surface or trough 14. The trough is shown as having a substantially concave lower surface as is common; however, the device of the present invention has utility with gutters having other configurations. The gutter 12 is disposed in a generally horizontal attitude with regard to a vertical surface of the house or other structure such as a wall 16. The wall may include shingles 18 or other weatherproofing siding material as is common.

The device includes an elongated handle 20 generally of hollow tubular construction and may be formed from conventional material such as relatively stiff metal or plastic tubing. The handle includes an upper section 22 which is somewhat inwardly bent so as to dispose a working head 24 connected thereto in operative position with the gutter 12. The opposite or lower end of the member 20 includes a handle 26 of generally elongated configuration and having a grip segment 28. The handle is normally separate from the member 20 and removably interconnected therewith. Such connection is accomplished by a frictional force-fit with an open ended tubular portion 30 outwardly extending from the upper end of the handle. Disposed between the grip 26 and the tubular portion 30 is a valve means 32 including a body 34 having a bore 36 formed therethrough and a movable valve member 38 positioned therein. The valve member includes a handle 40 which serves to rotate the valve member 38 so the bore 42 therein can be aligned with the bore 36. Additionally, the grip segment 26 is provided with a bore 44 and at the lower end thereof with an inwardly directed recess 46 for receipt of a garden hose extension 48. In this manner then, fluid such as water may be directed under pressure as from a garden hose 50 into the handle 26 and thence into the tubular member 20, it being clear that such flow can be easily regulated by the person manipulating the device 10, by means of the valve 32.

The construction of the working head 24 may best be seen by reference to FIGS. 2 through 4 wherein the overall configuration thereof is of relatively flat blade-like appearance. The head includes opposed generally parallel spaced sidewalls 52 and a generally U-shaped interconnecting wall 54 which in turn terminates in a lower head portion 56 which is arcuately convex so as to better conform with the trough portion 14 of the gutter 12. The upper portion 58 of the head is generally tubular and is provided with an inlet 60 for receipt of the terminal upper end 22 of member 20. Essentially then, the construction of the working head 24 is hollow and may be formed from separate segments, that is, the upper portion 58 forming one segment and the remaining portions forming another segment. Suitable materials for the construction of the head include: non-corrosive metals such as stainless steel and aluminum, and plastic resins including polyolefin compositions, polystyrene, ABS, and similar materials. When utilizing plastic materials, the upper section 58 may be dovetailed into the lower portion 54 so that the parts may be vibrationally secured together as by sonic welding or alternatively the parts may be joined by other conventional techniques including adhesives.

At least one and preferably both of the sidewalls 52 are provided with a plurality of fluid discharge openings 62. The openings extend entirely through the sidewalls 52 in such a manner that water directed to the device may be forced outwardly thereof on opposite sides thereof so as to force leaves and other debris in front of the working head as it is moved along the gutter either in a unidirectional or reciprocal motion. The openings 62 are preferably grouped so as to assume an arcuate configuration so that they each exit proximate to the lower peripheral extent thereof. In this way, the openings serve to direct individual streams of water 64 against the inner surface of the gutter as they emerge from the working head 24 rather than at some distance therefrom during which a significant portion of their debris removal power could be dissipated. It is also preferable that the orientation of the openings 62 is downwardly outwardly directed such that the individual streams 64 initially assume a somewhat downwardly directed pattern into direct contact with the trough surface 64 and thereafter assume a travel path parallel to the trough surface, and accordingly in a direction generally normal to the upright positioning of the head 24 in the gutter 12. It should also be understood that while the power of the streams 64 may be adequate to force debris away from the head and either directly out of the gutter or accumulate such for easy removal at one or several points therealong, that the head is also shaped such that it may act as a scraper or pusher to assist in forcing the debris out of or along the gutter trough, even without use of the water streams 64.

Additionally, the present device 10 may be utilized to wash the side walls, roof and windows of houses and such structures. For such purposes, as well as for providing a measure of adjustability when utilized in cleaning gutters, the working head 24 may, if desired, be rotatably mounted with respect to the terminal portion of the upper member 22. Accordingly, the connection between the upper member 22 and the extension 60 is of a force fit frictional nature, allowing for relative rotation of the head with respect thereto. Thus, the head 24 can be rotated out of its operational position as shown in FIG. 2 so as to direct fluid streams upwardly against overhanging portions of a building structure or the like. Additionally, the member 20 need not necessarily be of a single piece construction, and accordingly may include several segments, each of which may be frictionally connected to each other and accordingly rotatable with respect to the other. In this manner then, additional flexibility of use is afforded to the device such that the working head thereof may be positioned in various attitudes with respect to structures to be cleaned. It is particularly useful to be able to so utilize the device of the present invention inasmuch as gutter cleaning activity, in many cases, causes dirt, mud or the like to be splattered upon the sidewalls or windows of the house or other structure.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A gutter cleaning device adapted to remove leaves and other debris from an elevated roof gutter or the like, comprising an elongated generally tubular hollow member having a lower end adapted to be held by a person manipulating said device and an upper end adapted to reach the gutter when the device is in operative position, a working head attached to said member upper end, said working head of generally hollow closed integral construction and having sidewalls and a lower end wall defining a lower terminal portion adapted to downwardly extend into said gutter, said lower end wall being imperforate and shaped for substantial conforming contact with the inner lower surface of said gutter, at least one of said sidewalls including a plurality of fluid discharge openings extending therethrough and adapted to direct fluid longitudinally along said inner gutter surface so as to force leaves and debris therealong, said head having internal means for interconnecting said hollow handle with said discharge openings whereby fluid directed into said handle passes outwardly of said device through said openings.

2. The device of claim 1, said sidewalls being generally parallel to each other such that said head is of generally flat blade-like configuration adapted to be disposed in an upright position within a generally vertical plane while operational in said gutter, said discharge openings in said opposite sides accordingly adapted to direct a plurality of opposite generally horizontally directed fluid streams along said gutter and wherein both of said sidewalls are provided with outwardly directed discharge openings disposed proximal to said terminal head portion.

3. The device of claim 2, said terminal lower head portion being arcuately convex and said fluid discharge openings being downwardly outwardly directed.

4. The device of claim 2, said entire working head rotatably positioned with respect to said member such that the fluid streams emitted from said head may be directed against building portions other than interior gutter surfaces.

* * * * *